US012595535B2

(12) United States Patent
Wang et al.

(10) Patent No.: US 12,595,535 B2
(45) Date of Patent: Apr. 7, 2026

(54) CAST MAGNESIUM ALLOY WITH IMPROVED DUCTILITY

(71) Applicant: Magnesium Products of America Inc., Eaton Rapids, MI (US)

(72) Inventors: Gerry Gang Wang, London (CA); Jonathan Patrick Weiler, London (CA)

(73) Assignee: Magnesium Products of America Inc.

( * ) Notice: Subject to any disclaimer, the term of this patent is extended or adjusted under 35 U.S.C. 154(b) by 399 days.

(21) Appl. No.: 18/177,618

(22) Filed: Mar. 2, 2023

(65) Prior Publication Data

US 2023/0279524 A1 Sep. 7, 2023

Related U.S. Application Data

(60) Provisional application No. 63/316,608, filed on Mar. 4, 2022.

(51) Int. Cl.
*C22C 23/02* (2006.01)

(52) U.S. Cl.
CPC ..... *C22C 23/02* (2013.01)

(58) Field of Classification Search
CPC ..... C22C 23/02; C22C 23/00; C22F 1/06
See application file for complete search history.

(56) References Cited

U.S. PATENT DOCUMENTS

| | | | | |
|---|---|---|---|---|
| 1,743,849 A | | 1/1930 | Gann | |
| 3,278,343 A | | 10/1966 | Leuzinger | |
| 5,552,110 A | * | 9/1996 | Iba | C22C 23/04 420/407 |
| 5,811,058 A | * | 9/1998 | Baba | C22C 23/02 148/420 |
| 6,193,817 B1 | | 2/2001 | King et al. | |
| 2004/0163744 A1 | | 8/2004 | Oishi et al. | |
| 2021/0140017 A1 | | 5/2021 | Park et al. | |

FOREIGN PATENT DOCUMENTS

| | | | | |
|---|---|---|---|---|
| EP | 1 127 950 A1 | | 8/2001 | |
| GB | 2369625 A | * | 6/2002 | C22C 23/00 |
| JP | S63-109138 A | | 5/1988 | |
| WO | WO01/44529 | | 6/2021 | |

OTHER PUBLICATIONS

International Search Report and Written Opinion re Application No. PCT/US23/14376; 12 pages.
Chia, et al., Liquation and Liquation Cracking in Partially Melted Zones of Magnesium Welds, 11 pages.
Office Action issued in Canadian Appl. No. 3245430 dated Sep. 10, 2025.
Candan Sennur et al: "Comparative study on corrosion behaviors of Mg—Al—Zn alloys", Transactions of Nonferrous Metals Society of China, vol. 28, No. 4, Apr. 1, 2018 (Apr. 1, 2018), pp. 642-650.
Extended European Search Report issued in EP Appl. No. 23763933.1 dated Feb. 4, 2026.
Haitao Zhou et al: "Effect of cerium on microstructures and mechanical properties of AZ61 wrought magnesium alloy", Journal of Materials Science, Kluwer Academic Publishers, Bo, vol. 39, No. 23, Dec. 1, 2004 (Dec. 1, 2004), pp. 7061-7066.
Liu Bao-Sheng et al: "The influence of adding samarium on the microstructure, mechanical performance and corrosion behavior of as extruded AZ41 alloys", Journal of Physics and Chemistry of Solids, Pergamon Press, London, GB, vol. 150, Nov. 27, 2020.

* cited by examiner

*Primary Examiner* — Jessee R Roe
(74) *Attorney, Agent, or Firm* — Foley & Lardner LLP

(57) ABSTRACT

A magnesium alloy can include magnesium, about 3.4 wt % to about 5.5 wt % aluminum, about 0.40 wt % to about 1.5 wt % zinc, and about 0.26 wt % to about 0.36 wt % manganese. The magnesium alloy may exhibit an ultimate tensile strength from about 210 MPa to about 260 MPa, a yield strength from about 100 MPa to about 135 MPa, and an elongation from about 8% to about 15%. The magnesium alloy may exhibit a bend angle from about 46° to about 54°.

20 Claims, 15 Drawing Sheets

100

| Ingot specification | Al (wt%) | Zn (wt%) | Mn (wt%) | Si (wt%) | Cu (wt%) | Fe (wt%) | Ni (wt%) | Be (wt%) | Cl (wt%) |
|---|---|---|---|---|---|---|---|---|---|
| **Ingot spec** | 3.6 – 5.4 | 0.40 – 1.5 | 0.28 – 0.36 | 0.08 max | 0.008 max | 0.004 max | 0.001 max | 0.0005-0.0015 | 0.0050 max |
| **Casting spec** | 3.4 – 5.5 | 0.40 – 1.5 | 0.26 – 0.36 | 0.10 max | 0.010 max | 0.005 max | 0.002 max | | 0.0050 max |

FIG. 1

200

| Casting | Mg(wt%) | Al(wt%) | Zn(wt%) | Mn(wt%) | Si(wt%) | Cu(wt%) | Fe(wt%) | Ni(wt%) |
|---|---|---|---|---|---|---|---|---|
| **Composition 1** | Remainder | 3.93 | 0.41 | 0.31 | 0.030 | 0.0023 | 0.0025 | 0.0084 |
| **Composition 2** | Remainder | 3.98 | 0.65 | 0.31 | 0.032 | 0.0023 | 0.0025 | 0.0084 |
| **Composition 3** | Remainder | 4.49 | 0.64 | 0.31 | 0.031 | 0.0023 | 0.0025 | 0.0084 |
| **Composition 4** | Remainder | 5.01 | 0.98 | 0.31 | 0.034 | 0.0023 | 0.0025 | 0.0084 |
| **Composition 5** | Remainder | 4.99 | 1.20 | 0.31 | 0.032 | 0.0023 | 0.0025 | 0.0084 |
| **Composition 6** | Remainder | 3.47 | 0.61 | 0.33 | 0.018 | 0.0011 | 0.0023 | 0.0006 |
| **Composition 7** | Remainder | 4.34 | 0.93 | 0.35 | 0.021 | 0.001 | 0.0027 | 0.0006 |
| **AM50** | Remainder | 5 | 0.1 | 0.3 | 0.03 | 0.001 | 0.003 | 0.005 |
| **AM60** | Remainder | 6 | 0.1 | 0.3 | 0.03 | 0.001 | 0.003 | 0.005 |

FIG. 2

500

| | α-Mg(wt%) | $Mg_{17}Al_{12}$(wt%) | $Al_8Mn_5$(wt%) | AlMgZn-ϕ (wt%) |
|---|---|---|---|---|
| **Composition 1** | 96.1 | 3.5 | 0.27 | 0.18 |
| **Composition 2** | 95.7 | 3.7 | 0.28 | 0.39 |
| **Composition 3** | 95.1 | 4.3 | 0.31 | 0.35 |
| **Composition 4** | 93.8 | 5.2 | 0.33 | 0.50 |
| **Composition 5** | 93.6 | 5.2 | 0.34 | 0.69 |
| **Composition 6** | 96.3 | 3.0 | 0.25 | 0.40 |
| **Composition 7** | 94.8 | 4.2 | 0.30 | 0.51 |
| **AM50** | 95.3 | 4.3 | 0.39 | 0.00 |
| **AM60** | 94.0 | 5.7 | 0.35 | 0.00 |
| **AZ91** | 93.1 | 6.4 | 0.21 | 0.24 |

FIG. 5

700

| Alloy | Surface quality | Porosity (%) |
|---|---|---|
| Composition 1 | 100% | 1.2 |
| Composition 2 | 78% | 1.0 |
| Composition 4 | 92% | 0.6 |
| AM50 | 71% | - |
| AM60 | - | 4.8 |

FIG. 7

CAST MAGNESIUM ALLOY WITH IMPROVED DUCTILITY

CROSS-REFERENCE TO RELATED PATENT APPLICATIONS

This application claims the benefit of and priority to U.S. Patent Application No. 63/316,608, filed Mar. 4, 2022, the entire disclosure of which is hereby incorporated by reference herein.

TECHNICAL FIELD

The present application relates to improved magnesium alloys for use in structural components that can provide higher ductility than commonly used high pressure die cast (HPDC) magnesium die cast alloys.

BACKGROUND

Magnesium alloys have utility in a wide variety of applications, including for uses such as automotive applications (e.g., vehicle panels, structural members, and the like). One highly advantageous feature of using magnesium alloys in automotive applications is that such alloys provide high strength and good formability, and additionally can result in significant weight savings as compared to more traditional steel components.

It would be advantageous to provide an improved magnesium alloy that provides improved ductility while retaining other advantageous properties (e.g., mechanical properties, corrosion resistance, casting performance, recyclability, and cost). These and other advantageous features will become apparent to those reviewing the present disclosure.

SUMMARY

The systems and methods of the present disclosure are directed to an improved magnesium alloy. The improved magnesium alloy can have improved ductility, while maintaining strength, casting performance, hardness, and thermal conductivity, compared with conventional HPDC magnesium alloys (e.g., AM50, AM60, etc.). Compared with conventional magnesium alloys, the improved magnesium alloy can have less $Mg_{17}Al_{12}$ brittle phase and more Zn-containing phase (e.g., ϕ-AlMgZn phase).

At least one aspect of the present disclosure is directed to a magnesium alloy. The magnesium alloy includes magnesium, about 3.4 wt % to about 5.5 wt % aluminum, about 0.40 wt % to about 1.5 wt % zinc, and about 0.26 wt % to about 0.36 wt % manganese.

Another aspect of the present disclosure is directed to a magnesium alloy. The magnesium alloy exhibits an ultimate tensile strength from about 210 MPa to about 260 MPa, a yield strength from about 100 MPa to about 135 MPa, and an elongation from about 8% to about 15%. The magnesium alloy exhibits a bend angle from about 46° to about 54°.

Another aspect of the present disclosure is directed to a cast component. The cast component includes a magnesium alloy. The magnesium alloy includes magnesium, about 3.4 wt % to about 5.5 wt % aluminum, about 0.40 wt % to about 1.5 wt % zinc, and about 0.26 wt % to about 0.36 wt % manganese. The magnesium alloy exhibits an ultimate tensile strength from about 210 MPa to about 260 MPa, a yield strength from about 100 MPa to about 135 MPa, and an elongation from about 8% to about 15%. The magnesium alloy exhibits a bend angle from about 46° to about 54°.

Those skilled in the art will appreciate that this summary is illustrative only and is not intended to be in any way limiting. Other aspects, inventive features, and advantages of the devices and/or processes described herein, or as defined solely by the claims, will become apparent in the detailed description set forth herein and taken in conjunction with the accompanying drawings.

BRIEF DESCRIPTION OF THE DRAWINGS

The details of one or more implementations of the subject matter described in this specification are set forth in the accompanying drawings and the description below. Other features, aspects, and advantages of the subject matter will become apparent from the description, the drawings, and the claims.

FIG. 1 illustrates a table of composition values for ingots of the improved magnesium alloy and castings of the improved magnesium alloy, according to various embodiments.

FIG. 2 illustrates a table of composition values for a variety of alloys.

FIG. 5 illustrates a table of predicted phase composition values for a variety of alloys.

FIG. 7 illustrates a table of casting surface evaluations for a variety of alloys.

Like reference numbers and designations in the various drawings indicate like elements.

DETAILED DESCRIPTION

Figure 3:
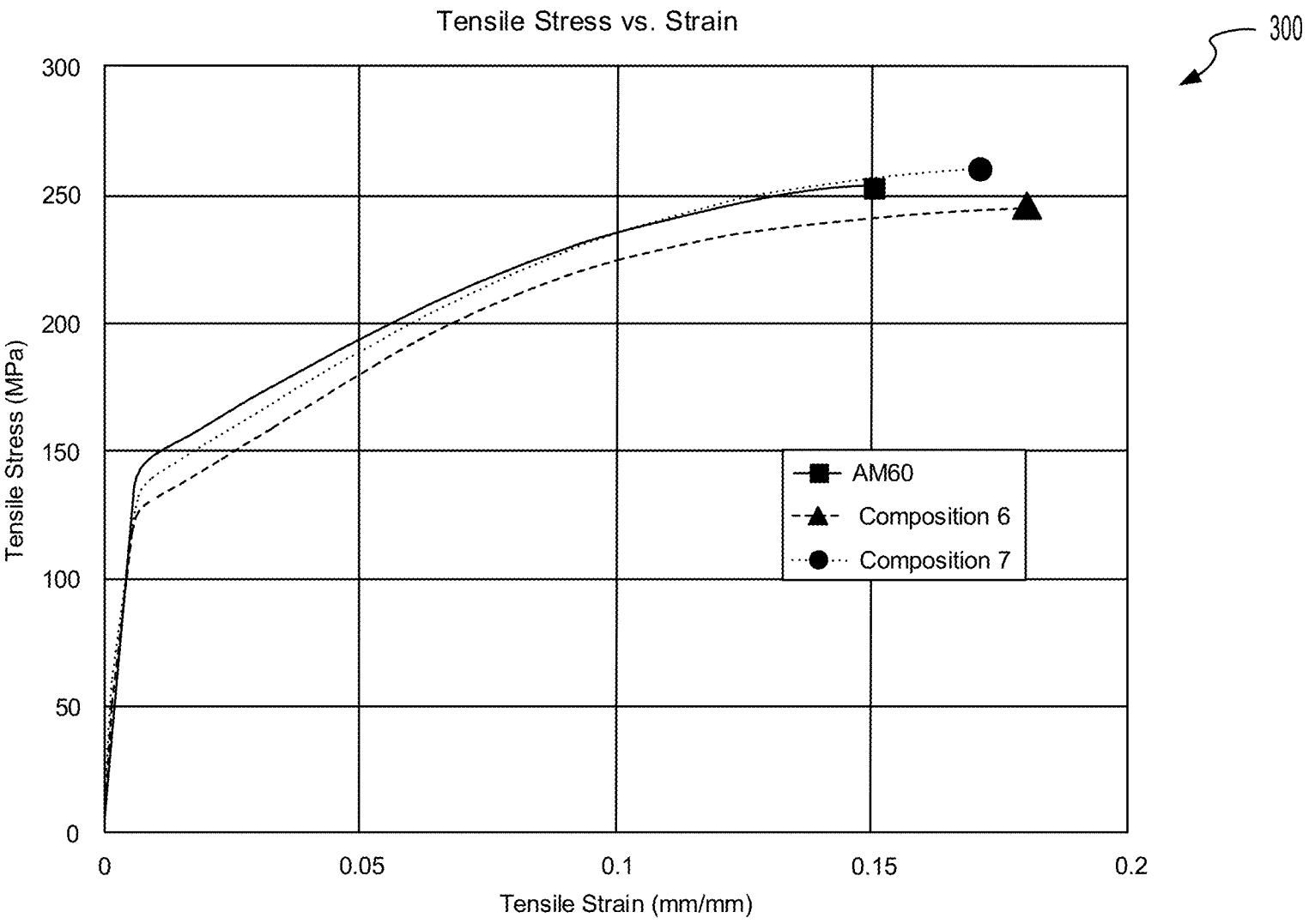
FIG. 3 illustrates a plot of stress-strain curves for three alloys.

Following below are more detailed descriptions of various concepts related to, and implementations of, methods, apparatuses, and systems for a magnesium alloy with improved ductility and strength. The various concepts introduced above and discussed in greater detail below may be implemented in any of a number of ways, as the described concepts are not limited to any particular manner of implementation. Examples of specific implementations and applications are provided primarily for illustrative purposes.

According to an exemplary embodiment, a magnesium alloy is provided that exhibits improved ductility while retaining other desirable characteristics of known magnesium alloys, including desirable mechanical properties, corrosion resistance, casting performance, recyclability, and cost. The improved magnesium alloy may exhibit a similar yield strength (YS) and ultimate tensile strength (UTS), with a higher ductility, as compared to baseline alloys. As used herein, the term 'baseline alloy' can include a standard magnesium alloy such as an AM50 alloy, an AM60 alloy, or an AZ91 alloy. The improved magnesium alloy may exhibit a higher yield strength and ultimate tensile strength, higher ductility, higher hardness, and/or higher thermal conductivity as compared to baseline alloys. The improved magnesium alloy may exhibit similar general corrosion properties and paintability to that of the baseline alloys. The improved magnesium alloy may exhibit a similar high pressure die casting (HPDC) castability to that of the baseline alloys. The improved magnesium alloy may have a similar or reduced cost compared to that of the baseline alloys. The improved magnesium alloy may exhibit improved tensile properties (e.g., yield strength, ultimate tensile strength, ductility, etc.) and corrosion resistance (e.g., salt immersion, salt spray, etc.) over the baseline alloys. The improved magnesium alloy may have fewer brittle intermetallic particles than the baseline alloys. The improved magnesium alloy may exhibit greater elongation with comparatively lower aluminum content than that of baseline alloys. Applications for the magnesium alloy can include powertrain and structural components.

According to a particular exemplary embodiment, the magnesium alloy includes magnesium, about 3.4 wt % to about 5.5 wt % aluminum, about 0.40 wt % to about 1.5 wt % zinc, and about 0.26 wt % to about 0.36 wt % manganese.

According to a particular exemplary embodiment, the magnesium alloy (e.g., improved magnesium alloy) exhibits an ultimate tensile strength from about 210 MPa to about 260 MPa, a yield strength from about 100 MPa to about 135 MPa, and an elongation from about 8% to about 15%. The magnesium alloy exhibits a bend angle from about 46° to about 54°.

According to a particular exemplary embodiment, a cast component includes a magnesium alloy (e.g., improved magnesium alloy). The magnesium alloy includes magnesium, about 3.4 wt % to about 5.5 wt % aluminum, about 0.40 wt % to about 1.5 wt % zinc, and about 0.26 wt % to about 0.36 wt % manganese. The magnesium alloy exhibits an ultimate tensile strength from about 210 MPa to about 260 MPa, a yield strength from about 100 MPa to about 135 MPa, and an elongation from about 8% to about 15%. The magnesium alloy exhibits a bend angle from about 46° to about 54°.

FIG. 1 illustrates a table 100 of composition values for ingots of the improved magnesium alloy and castings of the improved magnesium alloy. The improved magnesium alloy (e.g., an ingot of the improved magnesium alloy) can include about 95 wt % magnesium (Mg). The improved magnesium alloy can include about 3.6 wt % to about 5.4 wt % aluminum (Al). For example, the ingot of the improved magnesium alloy can include 3.6 wt % to 5.4 wt % aluminum. The improved magnesium alloy can include about 0.40 wt % to about 1.5 wt % zinc (Zn). For example, the ingot of the improved magnesium alloy can include 0.40 wt % to 1.5 wt % zinc. The improved magnesium alloy can include about 0.28 wt % to about 0.36 wt % manganese (Mn). For example, the ingot of the improved magnesium alloy can include 0.28 wt % to 0.36 wt % manganese. The improved magnesium alloy can include trace elements. Trace elements can include elements present at a concentration of less than or equal to 0.1 wt %. The trace elements in the improved alloy can include silicon (Si), copper (Cu), iron (Fe), nickel (Ni), beryllium (Be), and/or chlorine (Cl). The improved magnesium alloy can include 0 wt % to 0.08 wt % silicon. For example, the ingot of the improved magnesium alloy can include up to 0.08 wt % silicon. The improved magnesium alloy can include 0 wt % to 0.008 wt % copper. For example, the ingot of the improved magnesium alloy can include up to 0.008 wt % copper. The improved magnesium alloy can include 0 wt % to 0.004 wt % iron. For example, the ingot of the improved magnesium alloy can include up to 0.004 wt % iron. The improved magnesium alloy can include 0 wt % to 0.001 wt % nickel. For example, the ingot of the improved magnesium alloy can include up to 0.001 wt % nickel. The improved magnesium alloy can include 0.0005% to 0.0015 wt % beryllium. For example, the ingot of the improved magnesium alloy can include 0.0005% to 0.0015 wt % beryllium. The improved magnesium alloy can include 0 wt % to 0.0050 wt % chlorine. For example, the ingot of the improved magnesium alloy can include up to 0.0050 wt % chlorine.

In some embodiments, the improved magnesium alloy (e.g., a casting of the improved magnesium alloy, cast magnesium alloy) can include about 95 wt % magnesium. The improved magnesium alloy can include about 3.4 wt % to about 5.5 wt % aluminum. For example, the casting of the improved magnesium alloy can include 3.4% to 5.5 wt % aluminum. The improved magnesium alloy can include about 0.40 wt % to about 1.5 wt % zinc. The casting of the improved magnesium alloy can include 0.40% to 1.5 wt % zinc. The improved magnesium alloy can include about 0.26 wt % to about 0.36 wt % manganese. The casting of the improved magnesium alloy can include 0.26% to 0.36 wt % manganese. The improved magnesium alloy can include 0 wt % to 0.10 wt % silicon. The casting of the improved magnesium alloy can include up to 0.10 wt % silicon. The improved magnesium alloy can include 0 wt % to 0.010 wt % copper. The casting of the improved magnesium alloy can include up to 0.010 wt % copper. The improved magnesium alloy can include 0 wt % to 0.005 wt % iron. The casting of the improved magnesium alloy can include up to 0.005 wt % iron. The improved magnesium alloy can include 0 wt % to 0.002 wt % nickel. The casting of the improved magnesium alloy can include up to 0.002 wt % nickel. The improved magnesium alloy can include 0 wt % to 0.0050 wt % chlorine. The casting of the improved magnesium alloy can include up to 0.0050 wt % chlorine.

In some embodiments, the improved magnesium alloy can include about 95 wt % magnesium. The improved magnesium alloy can include about 3.4 wt % to about 5.5 wt % aluminum. The improved magnesium alloy can include about 0.40 wt % to about 1.5 wt % zinc. The improved magnesium alloy can include about 0.26 wt % to about 0.36 wt % manganese. The improved magnesium alloy can include 0 wt % to 0.10 wt % silicon. The improved magnesium alloy can include 0 wt % to 0.030 wt % copper. The improved magnesium alloy can include 0 wt % to 0.005 wt % iron. The improved magnesium alloy can include 0 wt % to 0.002 wt % nickel. The improved magnesium alloy can include 0.0005% to 0.0015 wt % beryllium.

FIG. 2 illustrates a table 200 of composition values for seven different specific alloy compositions for the improved magnesium alloy, which are hereinafter referred to as the Composition 1 alloy, Composition 2 alloy, Composition 3 alloy, Composition 4 alloy, Composition 5 alloy, Composition 6 alloy, and Composition 7 alloy. Such alloys may be used to create castings formed from an ingot, for example. The table 200 also includes comparative composition values for known AM50 and AM60 alloys.

The Composition 1 alloy includes about 95 wt % magnesium, about 4 wt % aluminum, and about 0.4 wt % zinc.

In one specific example, the Composition 1 alloy includes 95.3 wt % magnesium, 3.93 wt % aluminum, 0.41 wt % zinc, and 0.31 wt % manganese. The Composition 1 alloy can also optionally include trace elements (e.g., elements other than Mg, Al, Zn, and Mn present at a concentration of less than or equal to 0.1 wt %) such as trace elements of silicon, copper, iron, nickel, and/or beryllium. For example, the Composition 1 alloy can include one or more trace elements such as 0 wt % to 0.10 wt % silicon (e.g., 0.030 wt % silicon as illustrated), 0 wt % to 0.030 wt % copper (e.g., 0.0023 wt % copper), 0 wt % to 0.005 wt % iron (e.g., 0.0025 wt % iron), 0 wt % to 0.01 wt % nickel (e.g., 0.0084 wt % nickel), and/or 0.0005% to 0.0015 wt % beryllium, and combinations thereof.

The Composition 2 alloy can include about 95 wt % magnesium, about 4.0 wt % aluminum, and about 0.65 wt % zinc. In one specific example, the Composition 2 alloy includes 95.0 wt % magnesium, 3.98 wt % aluminum, 0.65 wt % zinc, and 0.31 wt % manganese, and can optionally include trace elements of silicon, copper, iron, nickel, and/or beryllium. For example, the Composition 2 alloy can include one or more trace elements such as 0 wt % to 0.10 wt % silicon (e.g., 0.032 wt % silicon), 0 wt % to 0.030 wt % copper (e.g., 0.0023 wt % copper), 0 wt % to 0.005 wt % iron (e.g., 0.0025 wt % iron), 0 wt % to 0.01 wt % nickel (e.g., 0.0084 wt % nickel), and/or 0.0005% to 0.0015 wt % beryllium, and combinations thereof.

The Composition 3 alloy can include about 95 wt % magnesium, about 4.5 wt % aluminum, and about 0.65 wt % zinc. In one specific example, the Composition 3 alloy includes 94.5 wt % magnesium, 4.49 wt % aluminum, 0.64 wt % zinc, and 0.31 wt % manganese, and can optionally include trace elements of silicon, copper, iron, nickel, and/or beryllium. For example, the Composition 3 alloy can include one or more trace elements such as 0 wt % to 0.10 wt % silicon (e.g., 0.031 wt % silicon), 0 wt % to 0.030 wt % copper (e.g., 0.0023 wt % copper), 0 wt % to 0.005 wt % iron (e.g., 0.0025 wt % iron), 0 wt % to 0.01 wt % nickel (e.g., 0.0084 wt % nickel), and/or 0.0005% to 0.0015 wt % beryllium, and combinations thereof.

The Composition 4 alloy can include about 95 wt % magnesium, about 5 wt % aluminum, and about 1 wt % zinc. In one specific example, the Composition 4 alloy includes 93.7 wt % magnesium, 5.01 wt % aluminum, 0.98 wt % zinc, and 0.31 wt % manganese, and can optionally include trace elements of silicon, copper, iron, nickel, and/or beryllium. For example, the Composition 4 alloy can include one or more trace elements such as 0 wt % to 0.10 wt % silicon (e.g., 0.034 wt % silicon), 0 wt % to 0.030 wt % copper (e.g., 0.0023 wt % copper), 0 wt % to 0.005 wt % iron (e.g., 0.0025 wt % iron), 0 wt % to 0.01 wt % nickel (e.g., 0.0084 wt % nickel), and/or 0.0005% to 0.0015 wt % beryllium, and combinations thereof.

The Composition 5 alloy can include about 95 wt % magnesium, about 5 wt % aluminum, and about 1.20 wt % zinc. In one specific example, the Composition 5 alloy includes 93.5 wt % magnesium, 4.99 wt % aluminum, 1.20 wt % zinc, 0.31 wt % manganese, and can optionally include trace elements of silicon, copper, iron, nickel, and/or beryllium. For example, the Composition 5 alloy can include one or more trace elements such as 0 wt % to 0.10 wt % silicon (e.g., 0.032 wt % silicon), 0 wt % to 0.030 wt % copper (e.g., 0.0023 wt % copper), 0 wt % to 0.005 wt % iron (e.g., 0.0025 wt % iron), 0 wt % to 0.01 wt % nickel (e.g., 0.0084 wt % nickel), and/or 0.0005% to 0.0015 wt % beryllium, and combinations thereof.

The Composition 6 alloy can include about 95 wt % magnesium, about 3 wt % aluminum, and about 0.5 wt % zinc. In one specific example, the Composition 6 alloy includes 95.6 wt % magnesium, 3.47 wt % aluminum, 0.61 wt % zinc, 0.33 wt % manganese, and can optionally include trace elements of silicon, copper, iron, nickel, and/or beryllium. For example, the Composition 6 alloy can include one or more trace elements such as 0 wt % to 0.10 wt % silicon (e.g., 0.018 wt % silicon), 0 wt % to 0.030 wt % copper (e.g., 0.0011 wt % copper), 0 wt % to 0.005 wt % iron (e.g., 0.0023 wt % iron), 0 wt % to 0.01 wt % nickel (e.g., 0.0006 wt % nickel), and/or 0.0005% to 0.0015 wt % beryllium, and combinations thereof.

The Composition 7 alloy can include about 94 wt % magnesium, about 4 wt % aluminum, and about 1 wt % zinc. In one specific example, the Composition 7 alloy includes 94.3 wt % magnesium, 4.34 wt % aluminum, 0.93 wt % zinc, 0.35 wt % manganese, and can optionally include trace elements of silicon, copper, iron, nickel, and/or beryllium. For example, the Composition 7 alloy can include one or more trace elements such as 0 wt % to 0.10 wt % silicon (e.g., 0.021 wt % silicon), 0 wt % to 0.030 wt % copper (e.g., 0.001 wt % copper), 0 wt % to 0.005 wt % iron (e.g., 0.0027 wt % iron), 0 wt % to 0.01 wt % nickel (e.g., 0.0006 wt % nickel), and/or 0.0005% to 0.0015 wt % beryllium, and combinations thereof.

As noted above, Compositions 1 through 7 each include the addition of manganese, which may provide several benefits. For example, the addition of manganese to a magnesium alloy can result in increased corrosion resistance for the alloy by forming Al—Mn—Fe intermetallic phases which can decrease the harmful effect of Fe on corrosion resistance. Manganese can also improve the aging effect of the magnesium alloys.

The addition of zinc to the magnesium alloy, as shown in the Composition 1-7 alloys, can reduce the presence of brittle intermetallic particles that make up the $Mg_{17}Al_{12}$ phase (e.g., $Mg_{17}Al_{12}$ brittle phase) content of the magnesium alloy. Manganese can be added to Mg—Al alloys to reduce corrosion. The improved magnesium alloy can include $\alpha$-Mg, $Mg_{17}Al_{12}$, $\varphi$-$Mg_6(Zn, Al)_5$, $\tau$-$Mg_{32}(Al, Zn)_{49}$, and $Mg_{12}Zn_{13}$ phases. The improved magnesium alloy can include $\alpha$-Mg, $Mg_{17}Al_{12}$, $Al_8Mn_5$, and $\phi$-AlMgZn phases.

The addition of zinc to the magnesium alloy, as shown in the Composition 1-7 alloys, can also improve solid solution strengthening of Mg—Al alloys and can improve the fluidity of Mg—Al alloys up to a limit. Increasing the zinc content up to 1.5 wt % may not degrade castability and surface condition of the cast alloys. However, the addition of zinc at 2 wt % to 3 wt %, or lower, may cause hot cracking.

By way of comparison, the known AM50 alloy can include about 95 wt % magnesium, 5 wt % aluminum, and about 0.1 wt % zinc. In one specific example, the AM50 alloy includes 94.4 wt % magnesium, 5 wt % aluminum, 0.1 wt % zinc, 0.3 wt % manganese, 0.03 wt % silicon, 0.001 wt % copper, 0.003 wt % iron, and 0.005 wt % nickel. The AM60 alloy can include about 95 wt % magnesium, 6 wt % aluminum, and about 0.1 wt % zinc. In one specific example, the AM60 alloy includes 93.4 wt % magnesium, 6 wt % aluminum, 0.1 wt % zinc, 0.3 wt % manganese, 0.03 wt % silicon, 0.001 wt % copper, 0.003 wt % iron, and 0.005 wt % nickel. The AM50 alloy and AM60 alloy are baseline alloys by which to compare the experimental magnesium alloys (e.g., Composition 1 alloy, Composition 2 alloy, Composition 3 alloy, Composition 4 alloy, Composition 5 alloy, Composition 6 alloy, or Composition 7 alloy).

FIG. 3 illustrates a plot 300 of stress-strain curves for the Composition 6 alloy, Composition 7 alloy, and AM60 alloy. These stress-strain curve can be derived from measurements of coupons cut from HPDC castings per ASTM B557 specification. The Composition 6 alloy exhibited lower yield strength and higher elongation than the AM60 alloy. The tensile strength of the Composition 6 alloy and the AM60 alloy are roughly equivalent. The Composition 6 alloy exhibited a greater capacity for absorbed energy compared to the AM60 alloy. The Composition 7 alloy exhibited lower yield strength and higher elongation than the AM60 alloy.

The magnesium alloy (e.g., improved magnesium alloy) may exhibit an ultimate tensile strength from about 210 MPa to about 260 MPa, such as from about 210 MPa to about 215 MPa, from about 210 MPa to about 220 MPa, from about 210 MPa to about 225 MPa, from about 210 MPa to about 230 MPa, about 210 MPa to about 235 MPa, about 210 MPa to about 240 MPa, about 210 MPa to about 245 MPa, about 210 MPa to about 250 MPa, about 210 MPa to about 255 MPa, about 210 MPa to about 260 MPa, from about 215 MPa to about 220 MPa, from about 215 MPa to about 225 MPa, from about 215 MPa to about 230 MPa, about 215 MPa to about 235 MPa, about 215 MPa to about 240 MPa, about 215 MPa to about 245 MPa, about 215 MPa to about 250 MPa, about 215 MPa to about 255 MPa, about 215 MPa to about 260 MPa, from about 220 MPa to about 225 MPa, from about 220 MPa to about 230 MPa, about 220 MPa to about 235 MPa, about 220 MPa to about 240 MPa, about 220 MPa to about 245 MPa, about 220 MPa to about 250 MPa, about 220 MPa to about 255 MPa, about 220 MPa to about 260 MPa, from about 225 MPa to about 230 MPa, about 225 MPa to about 235 MPa, about 225 MPa to about 240 MPa, about 225 MPa to about 245 MPa, about 225 MPa to about 250 MPa, about 225 MPa to about 255 MPa, about 225 MPa to about 260 MPa, about 230 MPa to about 235 MPa, about 230 MPa to about 240 MPa, about 230 MPa to about 245 MPa, about 230 MPa to about 250 MPa, about 230 MPa to about 255 MPa, about 230 MPa to about 260 MPa, about 235 MPa to about 240 MPa, about 235 MPa to about 245 MPa, about 235 MPa to about 250 MPa, about 235 MPa to about 255 MPa, about 235 MPa to about 260 MPa, about 240 MPa to about 245 MPa, about 240 MPa to about 250 MPa, about 240 MPa to about 255 MPa, about 240 MPa to about 260 MPa, about 245 MPa to about 250 MPa, about 245 MPa to about 255 MPa, about 245 MPa to about 260 MPa, about 250 MPa to about 255 MPa, about 250 MPa to about 260 MPa, about 255 MPa to about 260 MPa, or any range including and/or in-between any two of these values.

The magnesium alloy may exhibit a yield strength (e.g., tensile yield strength) from about 100 MPa to about 135 MPa, such as from about 100 MPa to about 105 MPa, from about 100 MPa to about 110 MPa, from about 100 MPa to about 115 MPa, from about 100 MPa to about 120 MPa, from about 100 MPa to about 125 MPa, from about 100 MPa to about 130 MPa, from about 100 MPa to about 135 MPa, from about 105 MPa to about 110 MPa, from about 105 MPa to about 115 MPa, from about 105 MPa to about 120 MPa, from about 105 MPa to about 125 MPa, from about 105 MPa to about 130 MPa, from about 105 MPa to about 135 MPa, from about 110 MPa to about 115 MPa, from about 110 MPa to about 120 MPa, from about 110 MPa to about 125 MPa, from about 110 MPa to about 130 MPa, from about 110 MPa to about 135 MPa, from about 115 MPa to about 120 MPa, from about 115 MPa to about 125 MPa, from about 115 MPa to about 130 MPa, from about 115 MPa to about 135 MPa, from about 120 MPa to about 125 MPa, from about 120 MPa to about 130 MPa, from about 120 MPa to about 135 MPa, from about 125 MPa to about 130 MPa, from about 125 MPa to about 135 MPa, from about 130 MPa to about 135 MPa, or any range including and/or in-between any two of these values.

The magnesium alloy may exhibit an elongation from about 8% to about 15%, such as from about 8% to about 9%, from about 8% to about 10%, from about 8% to about 11%, from about 8% to about 12%, from about 8% to about 13%, from about 8% to about 14%, from about 8% to about 15%, from about 9% to about 10%, from about 9% to about 11%, from about 9% to about 12%, from about 9% to about 13%, from about 9% to about 14%, from about 9% to about 15%, from about 10% to about 11%, from about 10% to about 12%, from about 10% to about 13%, from about 10% to about 14%, from about 10% to about 15%, from about 11% to about 12%, from about 11% to about 13%, from about 11% to about 14%, from about 11% to about 15%, from about 12% to about 13%, from about 12% to about 14%, from about 12% to about 15%, from about 13% to about 14%, from about 13% to about 15%, from about 14% to about 15%, or any range including and/or in-between any two of these values.

The magnesium alloy exhibits a bend angle from about 46° to about 54°, such as from about 46° to about 47°, from about 46° to about 48°, from about 46° to about 49°, from about 46° to about 50°, from about 46° to about 51°, from about 46° to about 52°, from about 46° to about 53°, from about 46° to about 54°, from about 47° to about 48°, from about 47° to about 49°, from about 47° to about 50°, from about 47° to about 51°, from about 47° to about 52°, from about 47° to about 53°, from about 47° to about 54°, from about 48° to about 49°, from about 48° to about 50°, from about 48° to about 51°, from about 48° to about 52°, from about 48° to about 53°, from about 48° to about 54°, from about 49° to about 50°, from about 49° to about 51°, from about 49° to about 52°, from about 49° to about 53°, from about 49° to about 54°, from about 50° to about 51°, from about 50° to about 52°, from about 50° to about 53°, from about 50° to about 54°, from about 51° to about 52°, from about 51° to about 53°, from about 51° to about 54°, from about 52° to about 53°, from about 52° to about 54°, from about 53° to about 54°, or any range including and/or in-between any two of these values.

Figure 4:
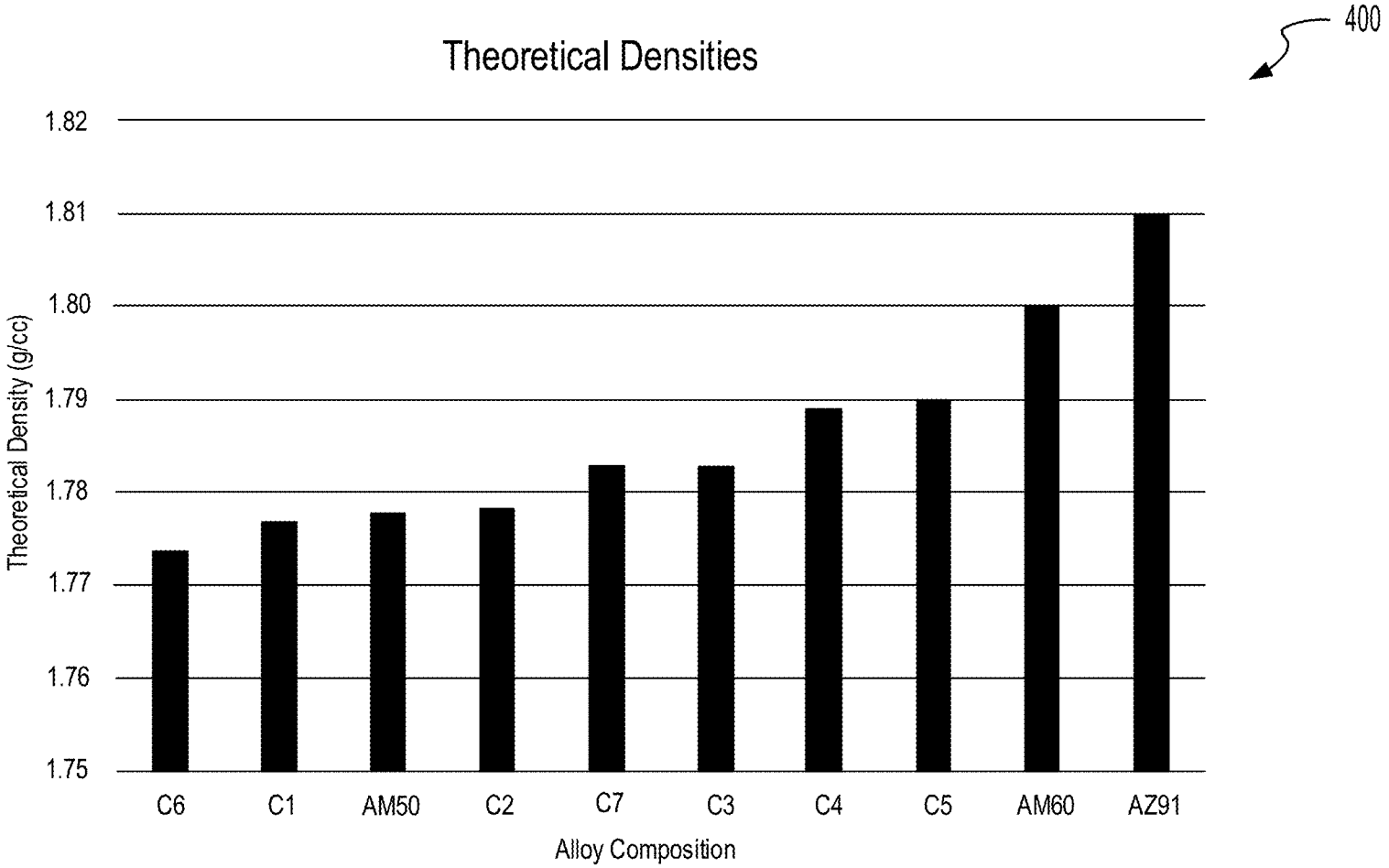
FIG. 4 illustrates a table of theoretical densities for a variety of alloys.

FIG. 4 illustrates a table 400 of theoretical densities for the Composition 1 alloy (C1), Composition 2 alloy (C2), Composition 3 alloy (C3), Composition 4 alloy (C4), Composition 5 alloy (C5), Composition 6 alloy (C6), Composition 7 alloy (C6), AM50 alloy (AM50), AM60 alloy (AM60), and AZ91 alloy (AZ91). The AM50 alloy (e.g., magnesium alloy with about 5% aluminum), AM60 alloy (e.g., magnesium alloy with about 6% aluminum), and AZ91 (e.g., magnesium alloy with about 9% aluminum and about 1% zinc) are baseline alloys by which to compare the experimental magnesium alloys (e.g., improved magnesium alloys). The theoretical density of the Composition 1 alloy can be lower than the densities of the AM50 alloy, AM60 alloy, and AZ91 alloy. The theoretical density of the Composition 2 alloy can be lower than the densities of the AM60 alloy and AZ91 alloy, and higher than the density of the AM50 alloy. The theoretical density of the Composition 3 alloy can be lower than the densities of the AM60 alloy and AZ91 alloy, and higher than the density of the AM50 alloy. The theoretical density of the Composition 4 alloy can be lower than the densities of the AM60 alloy and AZ91 alloy, and higher than the density of the AM50 alloy. The theoretical density of the Composition 5 alloy can be lower than the densities of the AM60 alloy and AZ91 alloy, and higher than the density of the AM50 alloy. The theoretical density of the Composition 6 alloy can be lower than the densities of the AM50 alloy, AM60 alloy, and AZ91 alloy. The theoretical density of the Composition 7 alloy can be lower than the densities of the AM60 alloy and AZ91 alloy, and higher than the density of the AM50 alloy. A lower density can result in a reduced mass of components which can lead to cost-savings. For example, for the same part design, a Composition 1 alloy component would have approximately 1.5% less mass than the AM60 alloy component.

FIG. 5 illustrates a table 500 of predicted phase composition values for the Composition 1 alloy, Composition 2 alloy, Composition 3 alloy, Composition 4 alloy, Composition 5 alloy, Composition 6 alloy, Composition 7 alloy, AM50 alloy, AM60 alloy, and AZ91 alloy. The Composition 1 alloy can include 96.1 wt % α-Mg, 3.5 wt % $Mg_{17}Al_{12}$, 0.27 wt % $Al_8Mn_5$, and 0.18 wt % ϕ-AlMgZn. The Composition 2 alloy can include 95.7 wt % α-Mg, 3.7 wt % $Mg_{17}Al_{12}$, 0.28 wt % $Al_8Mn_5$, and 0.39 wt % ϕ-AlMgZn. The Composition 3 alloy can include 95.1 wt % α-Mg, 4.3 wt % $Mg_{17}Al_{12}$, 0.31 wt % $Al_8Mn_5$, and 0.35 wt % ϕ-AlMgZn. The Composition 4 alloy can include 93.8 wt % α-Mg, 5.2 wt % $Mg_{17}Al_{12}$, 0.33 wt % $Al_8Mn_5$, and 0.50 wt % ϕ-AlMgZn. The Composition 5 alloy can include 93.6 wt % α-Mg, 5.2 wt % $Mg_{17}Al_{12}$, 0.34 wt % $Al_8Mn_5$, and 0.69 wt % ϕ-AlMgZn. The Composition 6 alloy can include 96.3 wt % α-Mg, 3 wt % $Mg_{17}Al_{12}$, 0.25 wt % $Al_8Mn_5$, and 0.40 wt % ϕ-AlMgZn. The Composition 7 alloy can include 94.8 wt % α-Mg, 4.2 wt % $Mg_{17}Al_{12}$, 0.30 wt % $Al_8Mn_5$, and 0.51 wt % ϕ-AlMgZn. The AM50 alloy can include 95.3 wt % α-Mg, 4.3 wt % $Mg_{17}Al_{12}$, 0.39 wt % $Al_8Mn_5$, and 0 wt % ϕ-AlMgZn. The AM60 alloy can include 94.0 wt % α-Mg, 5.7 wt % $Mg_{17}Al_{12}$, 0.35 wt % $Al_8Mn_5$, and 0 wt % ϕ-AlMgZn. The AZ91 alloy can include 93.1 wt % α-Mg, 6.4 wt % $Mg_{17}Al_{12}$, 0.21 wt % $Al_8Mn_5$, and 0.24 wt % ϕ-AlMgZn. Reducing the $Mg_{17}Al_{12}$ phase can result in improved ductility. Reducing the $Mg_{17}Al_{12}$ phase by forming ϕ-AlMgZn phase can result in improved ductility. For example, the Composition 2 alloy, Composition 6 alloy, and Composition 7 alloy have less $Mg_{17}Al_{12}$ phase and more ϕ-AlMgZn phase compared to the baseline alloys.

Figure 6:
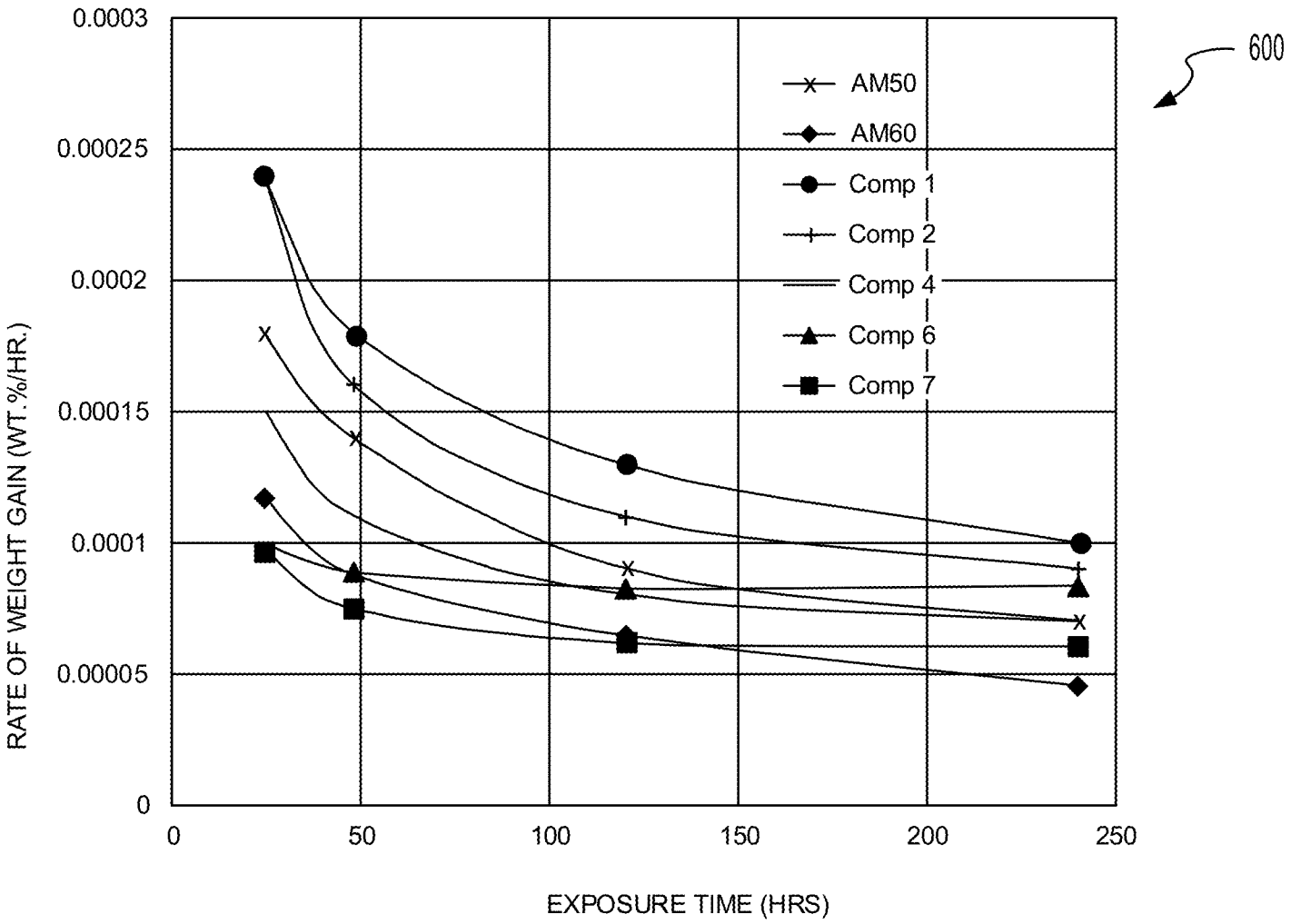
FIG. 6 illustrates a plot of corrosion performance for a variety of alloys.

FIG. 6 illustrates a plot 600 of corrosion performance for the Composition 1 alloy, Composition 2 alloy, Composition 4 alloy, Composition 6 alloy, Composition 7 alloy, AM50 alloy, and AM60 alloy. The corrosion performance was measured per ASTM B117 specification. The plot 600 shows the rate of mass accumulated (wt % per hour) vs. exposure time (hours) for the Composition 1 alloy, Composition 2 alloy, Composition 4 alloy, Composition 6 alloy, Composition 7 alloy, AM50 alloy, and AM60 alloy. A number of inclusions were found in the Composition 1 alloy, Composition 2 alloy, and Composition 4 alloy which can affect corrosion performance. The corrosion performance was measured from HPDC castings.

FIG. 7 illustrates a table 700 of casting surface evaluations for the Composition 1 alloy, Composition 2 alloy, Composition 4 alloy, AM50 alloy, and AM60 alloy. The casting surface evaluations (e.g., surface quality measurement) can include an evaluation of the surface for defects. The surface quality measurement can include a value ranging from 0% to 100%. Higher values (e.g., higher surface quality measurement values) can imply fewer defects in the surface (e.g., higher surface quality). The surface quality measurement of the Composition 1 alloy can be 100%. The surface quality measurement of the Composition 2 alloy can be 78%. The surface quality measurement of the Composition 4 alloy can be 92%. The surface quality measurement of the AM50 alloy can be 71%. The surface quality measurements illustrate HPDC casting quality and represent die castability and fluidity. The internal porosity can be measured per ASTM D792. The porosity of the Composition 1 alloy can be 1.2%. The porosity of the Composition 2 alloy can be 1.0%. The porosity of the Composition 4 alloy can be 0.6%. The porosity of the AM60 alloy can be 4.8%. The results can show that the improved magnesium alloys can have lower porosity levels than AM60 alloy castings. The surface quality and porosity measurements can show that the fluidity of the improved magnesium alloys can be the same or better than the baseline alloys.

Figure 8A:
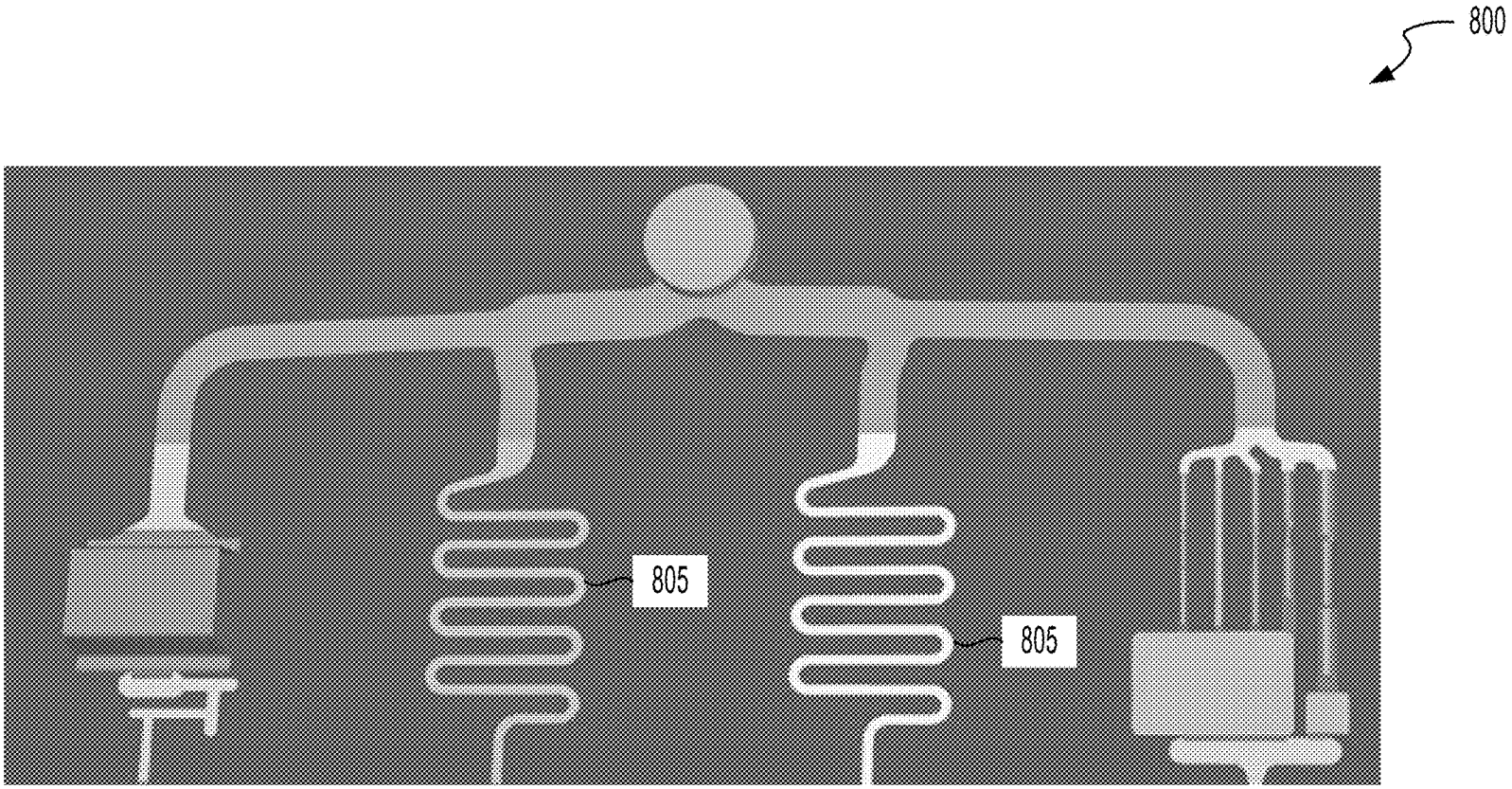
FIG. 8A illustrates a schematic of a fluidity die.
Figure 8B:
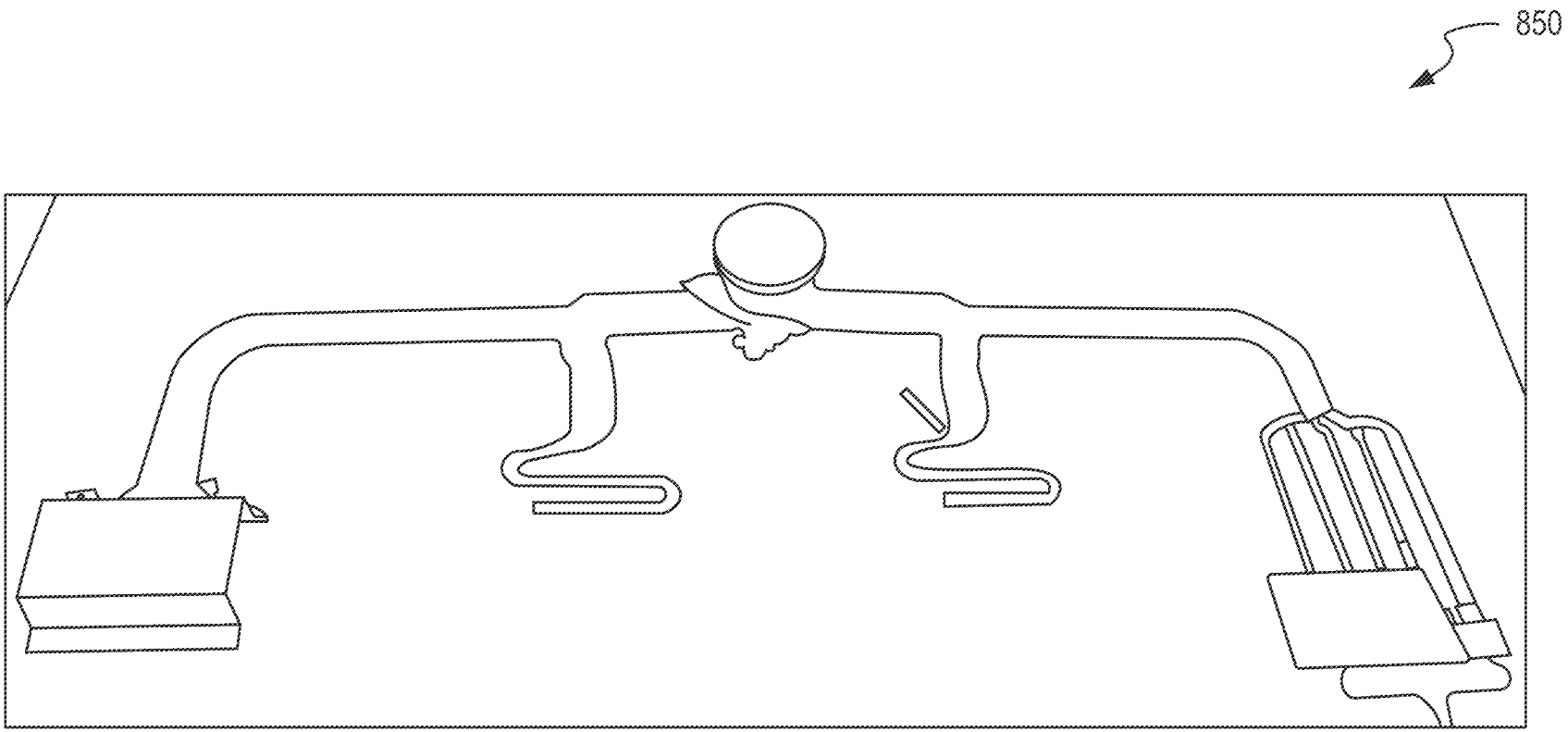
FIG. 8B illustrates a casting obtained from the fluidity die of FIG. 8A.
Figure 8C:
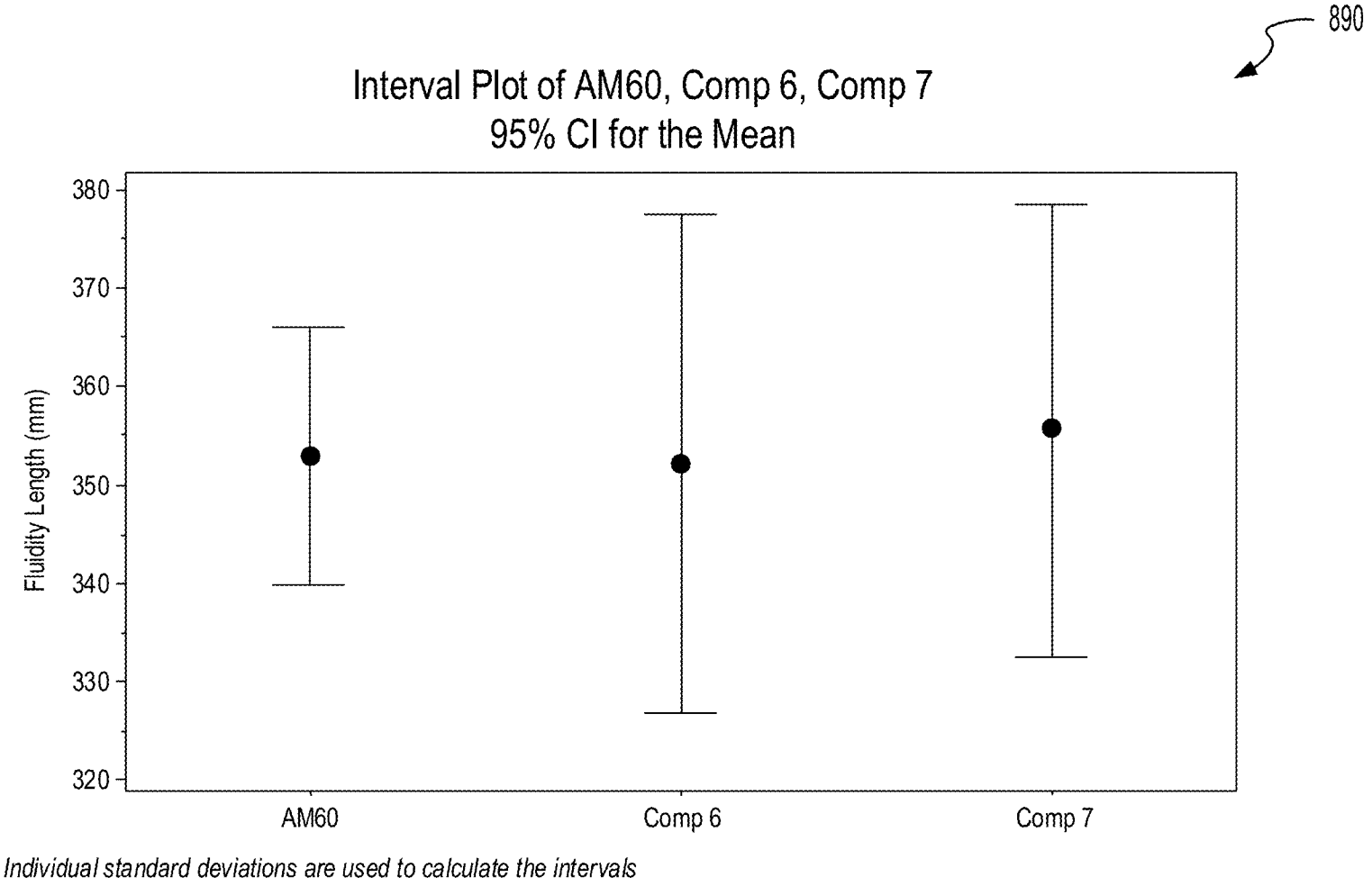
FIG. 8C illustrates a plot of fluidity length for a variety of alloys obtained from the fluidity die of FIG. 8A.

FIG. 8A illustrates a schematic of a fluidity die 800 (e.g., meander tool). The fluidity die 800 includes one or more meanders 805. A molten metal (e.g., alloy) can be cast into the fluidity die 800. The length of the shot (e.g., segment of the cast that is forced into the die) that is formed from the meander 805 can correspond to a fluidity length of the alloy. The fluidity die 800 can be used to cast a variety of alloys. FIG. 8B illustrates a casting 850 obtained from the fluidity die of FIG. 8A. The casting shown in FIG. 8B has a composition corresponding to the Composition 7 alloy. FIG. 8C illustrates a plot 890 of fluidity length for a variety of alloys obtained from the fluidity die 800 of FIG. 8A. The variety of alloys include the Composition 6 alloy, Composition 7 alloy, and AM60 alloy. The fluidity length can include the distance traveled by a molten alloy having a composition of the Composition 6 alloy, the Composition 7 alloy, or the AM60 alloy. The fluidity of the Composition 6 alloy can be equal to or greater than the fluidity of the AM60 alloy. The fluidity of the Composition 7 alloy can be equal to or greater than the fluidity of the AM60 alloy.

Figure 9:
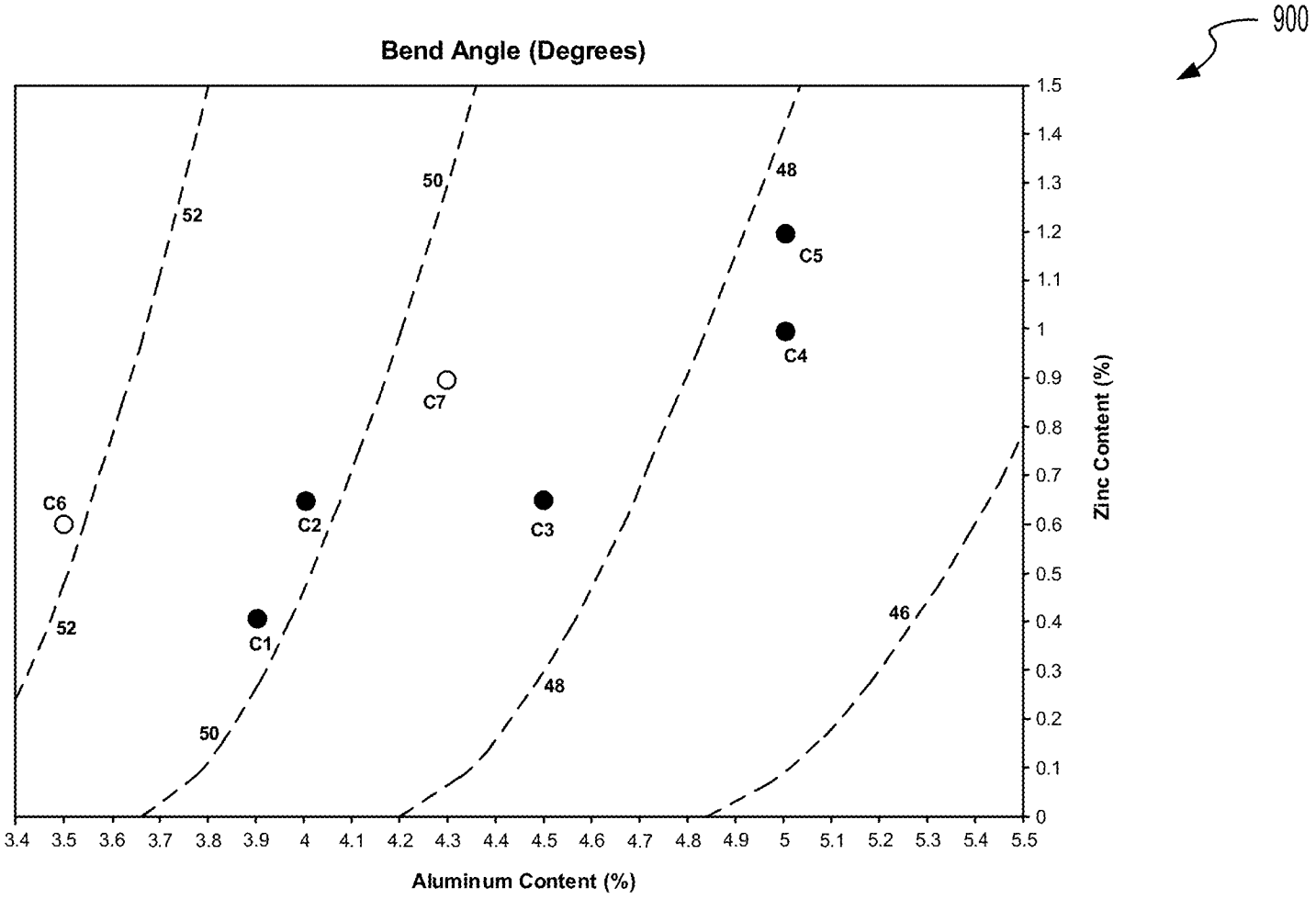
FIG. 9 illustrates a plot of bending test performance for a variety of alloys.

FIG. 9 illustrates a plot 900 of bending test performance for the Composition 1 alloy, Composition 2 alloy, Composition 3 alloy, Composition 4 alloy, Composition 5 alloy, Composition 6 alloy, and Composition 7 alloy. The bending test measurements were conducted per VDA 238-100. The predicted bend angle of the Composition 1 alloy can be approximately 50° (e.g., greater than 50°). The predicted bend angle of the Composition 2 alloy can be approximately 50° (e.g., greater than 50°). The predicted bend angle of the Composition 3 alloy can be approximately 48° (e.g., greater than 48°). The predicted bend angle of the Composition 4 alloy can be approximately 48° (e.g., less than 48°). The predicted bend angle of the Composition 5 alloy can be approximately 48° (e.g., less than 48°). The measured bend angle of the Composition 6 alloy can be approximately 52° (e.g., greater than 52°). The measured bend angle of the Composition 7 alloy can be approximately 50° (e.g., less than 50°).

Figure 10:
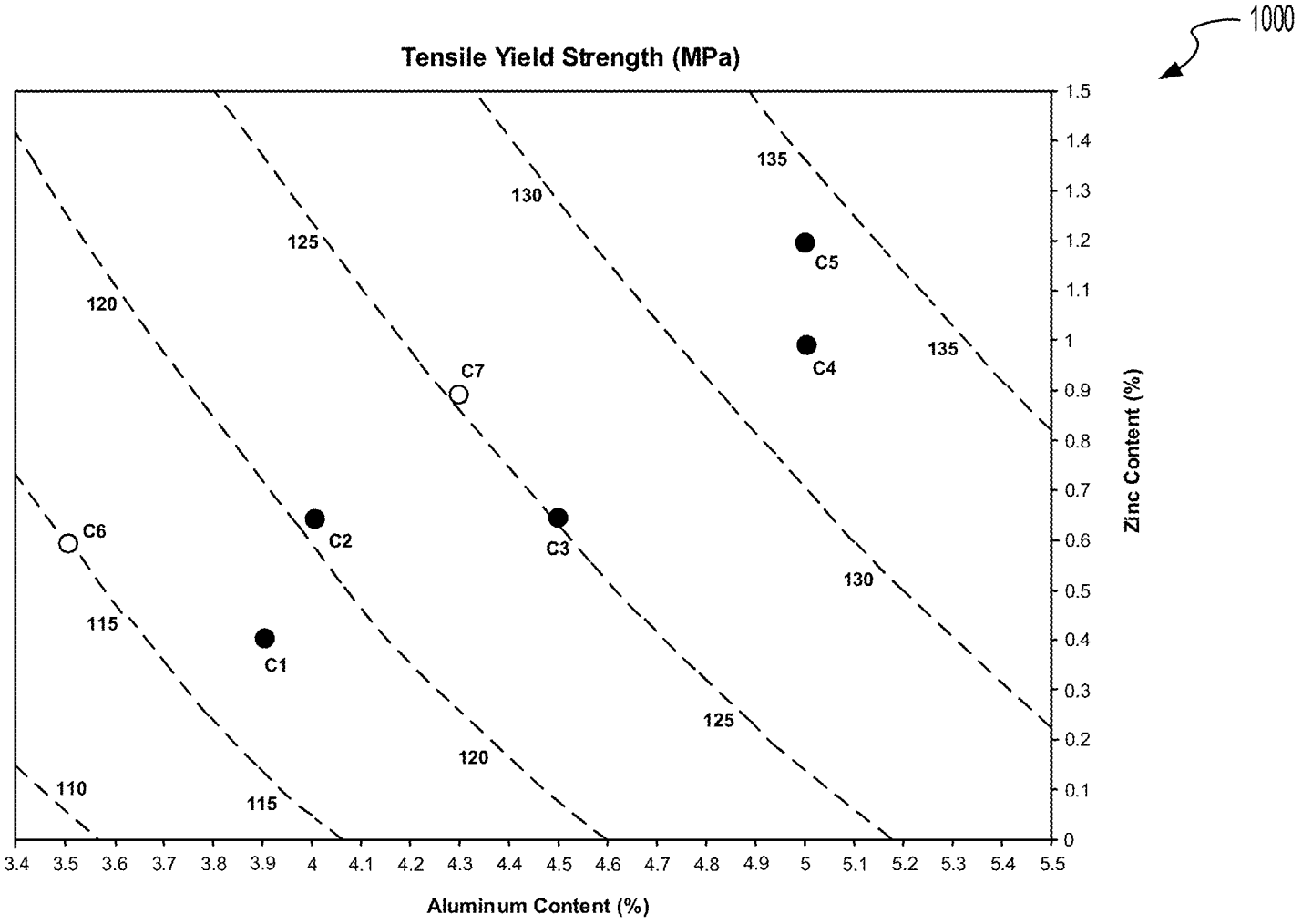
FIG. 10 illustrates a plot of yield strength for a variety of alloys.

FIG. 10 illustrates a plot 1000 of yield strength for the Composition 1 alloy, Composition 2 alloy, Composition 3 alloy, Composition 4 alloy, Composition 5 alloy, Composition 6 alloy, and Composition 7 alloy. The predicted yield strength (e.g., tensile yield strength) of the Composition 1 alloy can be approximately 117 MPa. The predicted yield strength of the Composition 2 alloy can be approximately 120 MPa (e.g., greater than 120 MPa). The predicted yield strength of the Composition 3 alloy can be approximately 125 MPa (e.g., greater than 125 MPa). The predicted yield strength of the Composition 4 alloy can be approximately 132 MPa (e.g., greater than 132 MPa). The predicted yield strength of the Composition 5 alloy can be approximately 135 MPa (e.g., less than 135 MPa). The measured yield strength of the Composition 6 alloy can be approximately 115 MPa. The measured yield strength of the Composition 7 alloy can be approximately 125 MPa.

Figure 11:
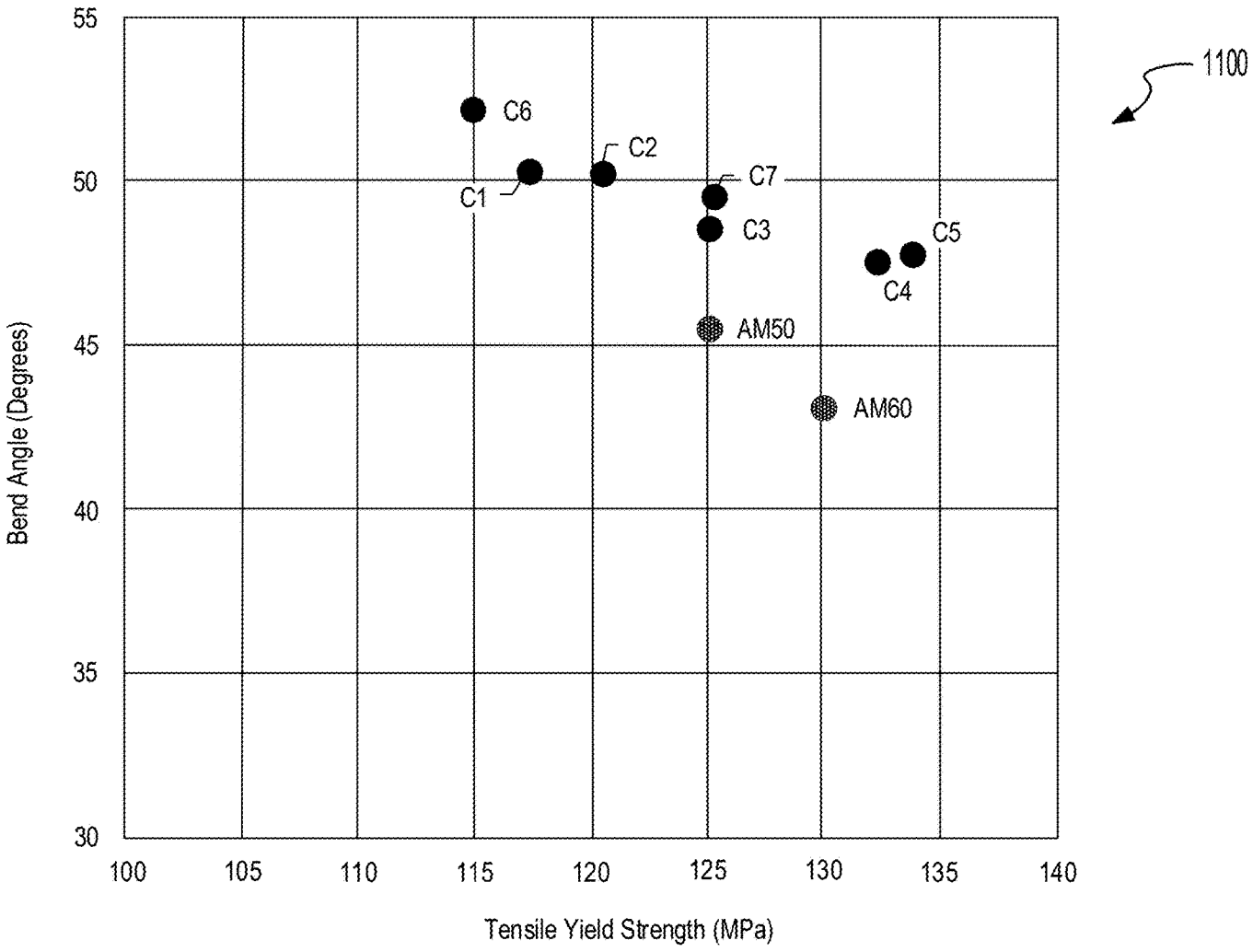
FIG. 11 illustrates a plot of bend angle vs. yield strength for a variety of alloys.

FIG. 11 illustrates a plot 1100 of bend angle vs. yield strength for the Composition 1 alloy, Composition 2 alloy, Composition 3 alloy, Composition 4 alloy, Composition 5 alloy, Composition 6 alloy, Composition 7 alloy, AM50 alloy, and AM60 alloy. The bend angle measurements were conducted per VDA-238-100. The Composition 7 alloy has a comparable or higher yield strength compared to the AM50 alloy. The Composition 7 alloy has a higher bend angle compared to the AM50 alloy. The Composition 6 alloy has the higher bend angle of the improved magnesium alloys. The Composition 6 alloy has a higher bend angle compared to the AM50 alloy and the AM60 alloy. The Composition 3 alloy has a comparable yield strength compared to the AM50 alloy. The Composition 3 alloy has a higher bend angle compared to the AM50 alloy. The Composition 4 alloy has a higher yield strength and bend angle compared to the AM50 alloy and AM60 alloy. The Composition 5 alloy has a higher yield strength and bend angle compared to the AM50 alloy and AM60 alloy. The bend angle was calculated using the VDA 238-100 bending test.

Figure 12:
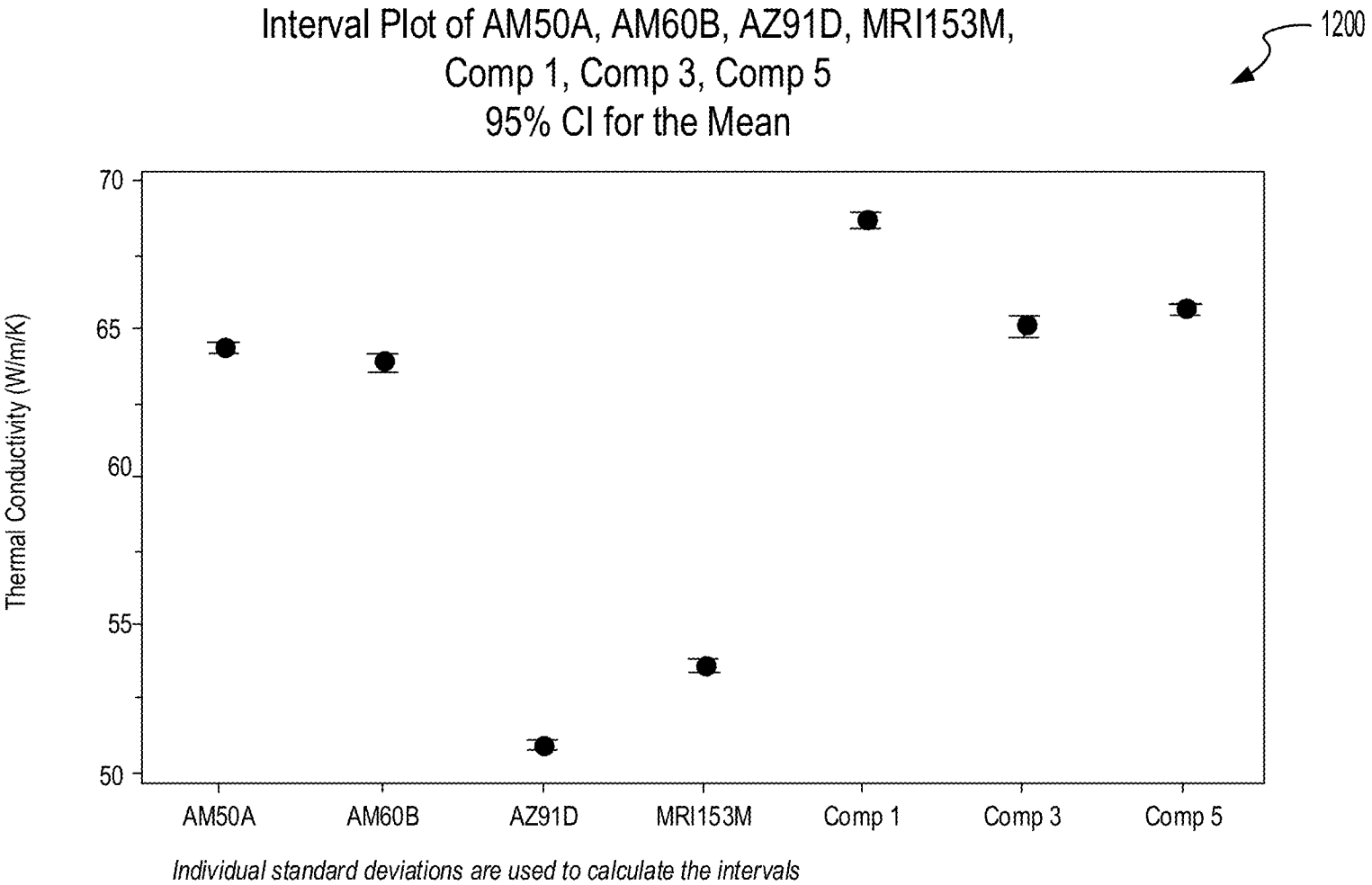
FIG. 12 illustrates a plot of thermal conductivity for a variety of alloys.

FIG. 12 illustrates a plot 1200 of thermal conductivity for the Composition 1 alloy, Composition 3 alloy, Composition 5 alloy, AM50 alloy, AM60 alloy, AZ91 alloy, and MRI153 alloy. The thermal conductivity tests were conducted per ISO/DIS 22007-2. As shown, the Composition 1, 3, and 5 alloys each have higher thermal conductivity than the baseline alloys. The thermal conductivity was measured from HPDC castings.

Figure 13:
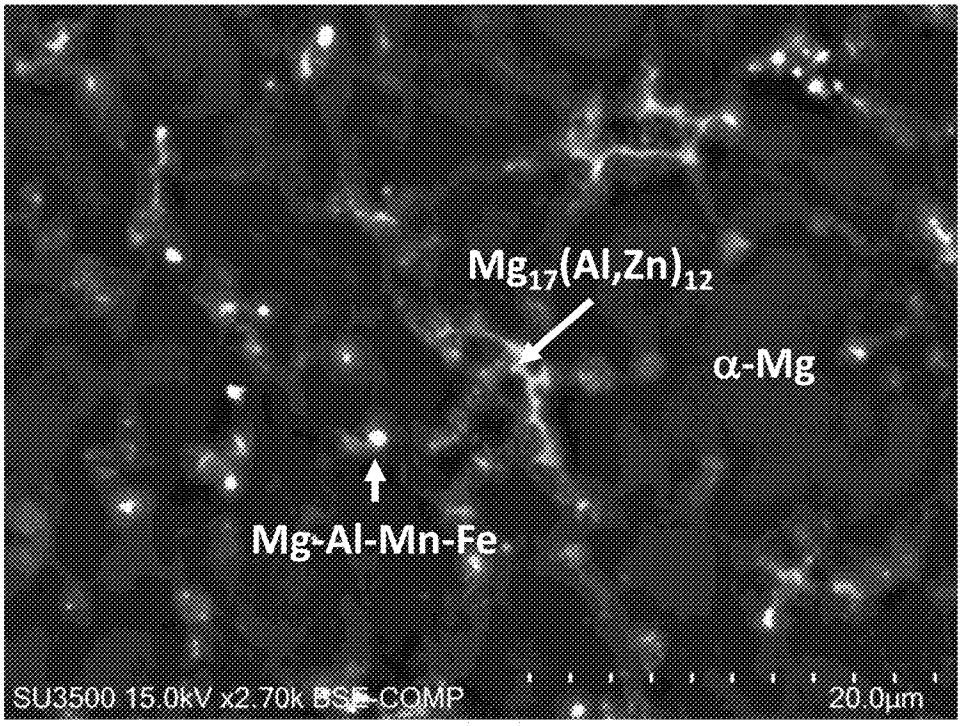
FIG. 13 illustrates a representative micrograph of a variety of alloys.

FIG. 13 illustrates a representative micrograph 1300 of the Composition 1 alloy, Composition 2 alloy, Composition 3 alloy, Composition 4 alloy, and Composition 5 alloy. The micrograph 1300 shows the microstructure of the Composition 1-5 alloys. The microstructure of the Composition 1-5 alloys includes include 4 main phases: $\alpha$-Mg, $Mg_{17}(Al, Zn)_{12}$, Mg—Al—Zn, and Mn—Mg—Al—Zn—Fe. The micrograph 1300 illustrates a HPDC casting.

The magnesium alloy disclosed above can be formed into a cast component (e.g., cast magnesium alloy component, cast alloy, etc.). The cast component can include any of the magnesium alloys described herein. For example, the magnesium alloy may include magnesium, about 3.4 wt % to about 5.5 wt % aluminum, about 0.40 wt % to about 1.5 wt % zinc, and about 0.26 wt % to about 0.36 wt % manganese. The magnesium alloy may exhibit an ultimate tensile strength from about 210 MPa to about 260 MPa, a yield strength from about 100 MPa to about 135 MPa, and an elongation from about 8% to about 15%. The magnesium alloy may exhibit a bend angle from about 46° to about 54°.

Any references to implementations or elements or acts of the systems and methods herein referred to in the singular can include implementations including a plurality of these elements, and any references in plural to any implementation or element or act herein can include implementations including only a single element. References in the singular or plural form are not intended to limit the presently disclosed systems or methods, their components, acts, or elements to single or plural configurations. References to any act or element being based on any information, act or element may include implementations where the act or element is based at least in part on any information, act, or element.

Any implementation disclosed herein may be combined with any other implementation, and references to "an implementation," "some implementations," "an alternate implementation," "various implementations," "one implementation" or the like are not necessarily mutually exclusive and are intended to indicate that a particular feature, structure, or characteristic described in connection with the implementation may be included in at least one implementation. Such terms as used herein are not necessarily all referring to the same implementation. Any implementation may be combined with any other implementation, inclusively or exclusively, in any manner consistent with the aspects and implementations disclosed herein.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 13" can include only 'A', only 'B', as well as both 'A' and 'B'. Elements other than 'A' and 'B' can also be included.

All disclosed ranges are to be understood to encompass and provide support for claims that recite any and all subranges or any and all individual values subsumed by each range. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth). Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member. Thus, for example, a group having 1-3 layers refers to groups having 1, 2, or 3 layers. Similarly, a group having 1-5 layers refers to groups having 1, 2, 3, 4, or 5 layers, and so forth.

The drawings shall be interpreted as illustrating one or more embodiments that are drawn to scale and/or one or more embodiments that are not drawn to scale. This means the drawings can be interpreted, for example, as showing: (a) everything drawn to scale, (b) nothing drawn to scale, or (c) one or more features drawn to scale and one or more features not drawn to scale. Accordingly, the drawings can serve to provide support to recite the sizes, proportions, and/or other dimensions of any of the illustrated features either alone or relative to each other. Furthermore, all such sizes, proportions, and/or other dimensions are to be understood as being variable from 0-100% in either direction and thus provide support for claims that recite such values or any and all ranges or subranges that can be formed by such values.

Unless explicitly indicated otherwise, all specified embodiments, features, and terms intend to include both the recited embodiment, feature, or term and biological equivalents thereof.

All patents, patent applications, provisional applications, and publications referred to or cited herein are incorporated by reference in their entirety, including all figures and tables, to the extent they are not inconsistent with the explicit teachings of this specification.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

In addition, where features or aspects of the disclosure are described in terms of Markush groups, those skilled in the art will recognize that the disclosure is also thereby described in terms of any individual member or subgroup of members of the Markush group.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The systems and methods described herein may be embodied in other specific forms without departing from the characteristics thereof. The foregoing implementations are illustrative rather than limiting of the described systems and methods.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

The systems and methods described herein may be embodied in other specific forms without departing from the characteristics thereof. The foregoing implementations are illustrative rather than limiting of the described systems and methods. Scope of the systems and methods described herein is thus indicated by the appended claims, rather than the foregoing description, and changes that come within the meaning and range of equivalency of the claims are embraced therein.

What is claimed is:

1. A magnesium alloy, comprising:
magnesium;
about 3.4 wt % to about 5.5 wt % aluminum;
about 0.40 wt % to about 1.5 wt % zinc;
about 0.26 wt % to about 0.36 wt % manganese; and
about 0.35 wt % to about 0.69 wt % φ-AlMgZn,
wherein the magnesium alloy has a ductility greater than a ductility of at least one of an AM50 alloy or an AM60 alloy.

2. The magnesium alloy of claim 1, wherein the magnesium alloy comprises:
about 4.3 wt % aluminum;
about 0.9 wt % zinc; and
about 0.3 wt % manganese.

3. The magnesium alloy of claim 1, wherein the magnesium alloy comprises:
about 3.5 wt % aluminum;
about 0.6 wt % zinc; and
about 0.3 wt % manganese.

4. The magnesium alloy of claim 1, wherein the magnesium alloy comprises:
5.0 wt % aluminum; and
1 wt % zinc.

5. The magnesium alloy of claim 1, further comprising α-Mg, $Mg_{17}Al_{12}$, and $Al_8Mn_5$.

6. The magnesium alloy of claim 1, further comprising α-Mg, $Mg_{17}Al_{12}$, φ-$Mg_6(Zn, Al)_5$, τ-$Mg_{32}(Al, Zn)_{49}$, and $Mg_{12}Zn_{13}$.

7. The magnesium alloy of claim 1, wherein the magnesium alloy exhibits an ultimate tensile strength from about 210 MPa to about 260 MPa.

8. The magnesium alloy of claim 1, wherein the magnesium alloy exhibits a yield strength from about 100 MPa to about 135 MPa.

9. The magnesium alloy of claim 1, wherein the magnesium alloy exhibits an elongation from about 8% to about 15%.

10. The magnesium alloy of claim 1, wherein the magnesium alloy exhibits a bend angle from about 46° to about 54°.

11. A cast component, comprising:
a magnesium alloy comprising:
magnesium;
about 3.4 wt % to about 5.5 wt % aluminum;
about 0.40 wt % to about 1.5 wt % zinc;
about 0.26 wt % to about 0.36 wt % manganese; and
about 0.35 wt % to about 0.69 wt % φ-AlMgZn,
wherein the magnesium alloy exhibits an ultimate tensile strength from about 210 MPa to about 260 MPa;
wherein the magnesium alloy exhibits a yield strength from about 100 MPa to about 135 MPa;
wherein the magnesium alloy exhibits an elongation from about 8% to about 15; %; and
wherein the magnesium alloy has a ductility greater than a ductility of at least one of an AM50 alloy or an AM60 alloy.

12. The cast component of claim 11, wherein the magnesium alloy comprises α-$Mg_{17}Al_{12}$, φ-$Mg_6(Zn, Al)_5$, τ-$Mg_{32}(Al, Zn)_{49}$, and $Mg_{12}Zn_{13}$.

13. The cast component of claim 11, wherein the magnesium alloy comprises α-Mg, $Mg_{17}Al_{12}$, and $Al_8Mn_8$.

14. The cast component of claim 11, wherein the magnesium alloy exhibits a bend angle from about 47° to about 52°.

15. The cast component of claim 11, wherein the magnesium alloy comprises:

less than 0.1 wt % copper.

16. The cast component of claim 11, wherein the magnesium alloy comprises:

0 wt % to 0.01 wt % copper.

17. The cast component of claim 11, wherein the magnesium alloy comprises trace elements comprising:

less than 0.10 wt % silicon;

less than 0.010 wt % copper;

less than 0.005 wt % iron; and less than 0.002 wt % nickel.

18. The cast component of claim 11, wherein the magnesium alloy comprises:

about 0.51 wt % φAlMgZn; and about 4.2 wt % $Mg_{17}Al_{12}$.

19. The cast component of claim 11, wherein the magnesium alloy comprises about 3.0 wt % to about 4.2 wt % $Mg_{17}Al_{12}$.

20. The cast component of claim 11, wherein the magnesium alloy comprises:

about 0.40 wt % φ-AlMgZn; and about 3.0 wt % $Mg_{17}Al_{12}$.

* * * * *